United States Patent [19]

Waid et al.

[11] 4,370,178

[45] Jan. 25, 1983

[54] METHOD OF MAKING AS-PIERCED TUBULAR PRODUCTS

[75] Inventors: George M. Waid, Burton; Anthony T. Davenport, Shaker Heights, both of Ohio

[73] Assignee: Republic Steel Corporation, Cleveland, Ohio

[21] Appl. No.: 278,997

[22] Filed: Jun. 30, 1981

[51] Int. Cl.[3] ..... C21D 8/10

[52] U.S. Cl. ..... 148/12 F; 148/36

[58] Field of Search ..... 148/12 R, 12 F, 12.4, 148/36

[56] References Cited

U.S. PATENT DOCUMENTS

| | | | |
|---|---|---|---|
| Re. 28,878 | 6/1976 | Korchynsky et al. | 75/123 |
| 3,173,782 | 3/1965 | Melloy et al. | 75/123 |
| 3,562,028 | 2/1971 | Heitmann et al. | 148/36 |
| 3,661,537 | 5/1972 | Aronson et al. | 75/123 |
| 3,666,452 | 5/1972 | Korchynsky et al. | 75/123 |
| 3,666,570 | 5/1972 | Korchynsky et al. | 148/36 |
| 3,725,049 | 4/1973 | Satoh et al. | 75/125 |
| 3,725,049 | 7/1974 | Melloy et al. | 148/12 |
| 3,918,691 | 11/1975 | Sekine et al. | 148/12 F |
| 3,976,514 | 8/1976 | Matsukura et al. | 148/12 F |
| 3,982,969 | 9/1976 | Koros et al. | 148/12 F |
| 3,997,372 | 12/1976 | Matas et al. | 148/36 |
| 4,008,103 | 2/1977 | Miyoshi et al. | 148/12 F |
| 4,137,104 | 1/1979 | Nashiwa et al. | 148/36 |

OTHER PUBLICATIONS

"Steel Tubular Products", Metals Handbook, Ninth Edition, vol. 1, Properties and Selection:Irons and Steels, ASM, 1978, pp. 315–326.

Klausting et al., "Development of High Tensile Strength Steel for Building Construction", Sta., Jan. 1965, pp. 48–52.

Irvine et al., "Low-Carbon Steel with Ferrite-Pearlite Structures", Journal of the Iron and Steel Institute, Nov. 1963, pp. 944–959.

Irvine et al., "Grain-Refined C-M Steels", Journal of the Iron and Steel Institute, Feb. 1967, pp. 161–182.

Metals Handbook, 9th Edition, vol. I, "Properties and Selection:Irons and Steels", 1978, pp. 188, 189.

*Primary Examiner*—Peter K. Skiff

*Attorney, Agent, or Firm*—Watts, Hoffmann, Fisher & Heinke Co.

[57] ABSTRACT

Process of making as-pierced tubular steel casing having a yield strength of 80–110 ksi, a minimum tensile strength of 100 ksi, and a minimum elongation of 12½% in two inches. The steel is stengthened by precipitation of vanadium carbides, including carbonitrides, and has a ferrite-pearlite microstructure with a ferrite grain size of about ASTM 7 or finer.

1 Claim, No Drawings

METHOD OF MAKING AS-PIERCED TUBULAR PRODUCTS

TECHNICAL FIELD

The present invention relates generally to the production of tubular products, such as steel casing, couplings and the like, and more specifically to the manufacture of as-pierced tubular products which, in the as-pierced condition, are characterized by high yield and tensile strengths, good elongation and toughness.

BACKGROUND ART

The invention is particularly concerned with the manufacture of as-pierced tubular casing and the like which meet the American Petroleum Institute (API) casing requirements of 80–110 ksi yield strength, 100 ksi minimum ultimate tensile strength, and minimum elongation of 12½% in two inches. Heretofore, these requirements have been met either by normalizing or by quenching and tempering. Both of these conventional heat treatment practices have certain disadvantages which the present invention avoids.

Normalized casing steels are aluminum killed and typically characterized by an average composition including about 0.45–0.50 carbon, 1.5 manganese, 0.25 silicon, 0.05 chromium, and 0.16 molybdenum. One difficulty involved in the production of normalized casing having the mechanical properties specified above is the formation of excessive bainite. The formation of bainite makes it difficult to achieve the required elongation.

Quenched and tempered casing meeting API specifications has been characterized by a nominal composition including about 0.35 carbon, 1.3 manganese, 0.25 chromium, and 0.05 molybdenum. Quench and temper heat treatment of the casing has the disadvantage of high energy and handling costs.

Prior to the present invention, there has been no known commercially available casing meeting the API specifications in the as-pierced condition. The reason for this is that at least 75% of the total reduction in the piercing operation is done at temperatures of 2250° F. or higher. The high temperatures produce large austenite grains ranging from 0 to about 6 ASTM with the result that it is difficult to achieve the desired elongation in the as-pierced condition. Other problems that have been encountered in attempts to make as-pierced casing from standard compositions have included widely varying grain sizes and hard and brittle spots in the casing.

DISCLOSURE OF THE INVENTION

The purpose of this invention is to provide a tubular product, such as oil well casing, which meets the requirements of 80–110 ksi yield strength, 100 ksi minimum ultimate tensile strength and 12½% minimum elongation in the as-pierced condition, i.e., without conventional heat treatment procedures such as normalizing or quenching and tempering.

It has been found that it is possible to achieve the desired combination of mechanical properties in the as-pierced condition by making the casing or other tubular product from a controlled, precipitation hardenable composition. The basic steel composition contemplated for use in carrying out the invention contains carbon, manganese and vanadium and is critically balanced to optimize the precipitation strengthening effect of vanadium carbonitrides and/or vanadium carbides.

The precipitation of vanadium carbonitrides and/or vanadium carbides results in grain refinement and thereby makes it possible to achieve the desired mechanical properties, including good elongation, without heat treatment. The precipitation effect and grain refining achieves an austenite grain size of ASTM 5 or finer and a ferrite grain size of ASTM 7 or finer.

The invention more particularly provides a process of making as-pierced steel casing characterized in the as-pierced condition by a yield strength of 80–110 ksi, a minimum ultimate tensile strength of 100 ksi, a minimum elongation of 12½% in two inches, and a ferrite-pearlite microstructure having a ferrite grain size of about ASTM 7 or finer, comprising the steps of providing a killed steel consisting essentially in percent by weight of from 0.20–0.35 carbon, 1.0–2.0 manganese, up to about 0.60 silicon, up to about 0.04 for each of phosphorous and sulfur, 0.05–0.25 vanadium, at least one of from 0.005–0.025 nitrogen and from 0.01–0.10 columbium, and the balance iron, heating the steel to a temperature of at least about 2200° F. to dissolve vanadium carbides, piercing said steel, and allowing said steel to cool from said temperature to effect precipitation of vanadium carbides with resulting refinement of austenite to a grain size of about ASTM 5 or finer and ferrite to a grain size of about ASTM 7 or finer.

Another aspect of the invention is an as-pierced, killed steel casing characterized by a yield strength of 80–110 ksi, a minimum ultimate tensile strength of 100 ksi, a minimum elongation of about 12½% in two inches, and a ferrite-pearlite microstructure having a ferrite grain size of ASTM 7 or finer, said casing having a composition consisting essentially in percent by weight of 0.20–0.35 carbon, 1.0–2.0 manganese, up to about 0.60 silicon, up to about 0.04 for each of phosphorous and sulfur, 0.05–0.25 vanadium, at least one of from 0.005–0.025 nitrogen and from 0.01–0.10 columbium, and the balance iron.

In more specific embodiments, the steel composition utilized in carrying out the invention consists essentially in percent by weight of from 0.20–0.30 carbon, 1.2–1.6 manganese, 0.10–0.40 silicon, up to about 0.04 for each of phosphorous and sulfur, 0.10–0.20 vanadium, 0–0.10 columbium, 0.01–0.02 nitrogen, and the balance iron. Especially preferred compositions contain from 0.01–0.05 columbium for grain refinement purposes.

The interphase strengthening mechanism achieved by the precipitation of vanadium carbides, which term includes vanadium carbonitrides, is recognized in the art, and various products, for example, plates and bars, made from precipitation hardenable compositions corresponding to that used in carrying out the present invention have been sold commercially during the past few years. Interphase precipitation, which occurs as austenite transforms to proeutectoid ferrite, requires heating the steel to a temperature sufficient to dissolve a substantial amount of the vanadium content. In the case of the present invention, the steel is heated to temperature of at least about 2200° F. for the piercing operation. In the initial stages of ferrite formation during cooling of the steel, the rejection of carbon from the ferrite causes local carbon enrichment of the austenite-ferrite interphase boundary. This, in turn, stimulates the precipitation of fine particles of vanadium carbide on the interphase boundary. These carbides grow and absorb carbon to the extent that ferrite continues to grow. At a later stage, the precipitation process repeats itself when the boundary conditions are re-established. The process leaves the vanadium carbide particles arranged in sheets that closely follow the contours of the alpha-gamma interface as it moves through the steel.

It is believed the precipitation of the carbides prevents coarsening of the austenite grains and low ductility. In the case of the present invention, the austenite grain size is about ASTM 5 or finer. The carbide precipitation effect also results in fine ferrite grains of ASTM 7 or finer. A further advantage of the interphase precipitation mechanism in the manufacture of as-pierced tubular products is the elimination of hard spots and grain size variations.

Additional advantages and a fuller understanding of the invention will be had from the following detailed description.

BEST MODE FOR CARRYING OUT THE INVENTION

The new, as-pierced tubular product of the invention is made from a carbon-manganese-ferrite-pearlite steel that is alloyed with vanadium in order to achieve high strength and grain refinement through precipitation of vanadium carbides, including vanadium carbonitrides. The carbon and manganese contents are maintained at levels necessary to attain the desired minimum yield strength of 80 ksi, and yet are controlled to prevent the formation of bainite and martensitic products which are detrimental to ductility and toughness.

The carbon content may range from about 0.20 to 0.35, with the preferred range being from 0.20 to 0.30. The manganese content may range from about 1.0 to 2.0 with a preferred range being from 1.2 to 1.6. Manganese in excess of 1.5 may cause the formation of secondary bainite and a deterioration of yield strength. It will be understood by those working in the art that nickel can be substituted for part of the manganese according to the ratio of about 2 to 3 parts nickel for one part manganese. As used herein, the term "manganese" means manganese alone as well as its equivalent in terms of nickel substituted according to the foregoing ratio.

Optimum welding properties are promoted by minimizing the carbon equivalence as determined by formula:

$$C.E. = \frac{Mn}{6} + \frac{Cr + Mo + V}{5} + \frac{Ni + Cu}{15}$$

On the basis of carbon equivalence, it has been found that the vanadium alloyed, carbon-manganese-ferrite-pearlite steel used in the invention offers better welding performance than bainitic steels of equivalent yield strength. The preferred steel displays the minimum yield strength of 80 ksi with a carbon equivalence of about 0.45–0.55.

The substantial strengthening effect of vanadium largely results from the precipitation strengthening mechanism described above. A critical minimum level of vanadium is required to achieve the desired high strengths and uniform, fine grain sizes in an as-pierced product. The importance of the vanadium content on strength is demonstrated in Table I.

TABLE I

| Steel | C | Mn | Si | V | Cb | N | Al | Yield Strength ksi |
|---|---|---|---|---|---|---|---|---|
| A | .20 | 1.51 | 0.23 | — | — | 0.016 | 0.020 | 62.7 |
| B | .23 | 1.35 | 0.09 | 0.07 | 0.014 | 0.004 | 0.032 | 76.0 |
| C | .24 | 1.33 | 0.027 | 0.09 | 0.015 | 0.016 | 0.010 | 80.0 |
| D | .21 | 1.38 | 0.14 | 0.10 | 0.075 | 0.016 | 0.028 | 78.0 |
| E | .22 | 1.53 | 0.19 | 0.10 | — | 0.016 | 0.024 | 83.0 |
| F | .22 | 1.50 | 0.25 | 0.12 | — | 0.013 | 0.045 | 81.5 |
| G | .23 | 1.56 | 0.26 | 0.15 | 0.029 | 0.017 | 0.062 | 84.5 |
| H | .20 | 1.44 | 0.23 | 0.20 | — | 0.016 | 0.017 | 80.5 |
| I | .21 | 1.41 | 0.22 | 0.20 | 0.092 | 0.016 | 0.026 | 82.0 |
| J | .23 | 1.50 | 0.24 | 0.21 | — | 0.015 | 0.040 | 86.5 |
| K | .23 | 1.54 | 0.26 | 0.19 | 0.029 | 0.018 | 0.062 | 86.8 |
| L | .20 | 1.43 | 0.25 | 0.16 | — | 0.016 | 0.025 | 82.0 |

In order to achieve the desired mechanical properties and grain refinement, the steel compositions used in carrying out the invention must include either nitrogen in range of from 0.005 to 0.025 or columbium in the range of from 0.01 to 0.10. The preferred compositions include nitrogen in a range of from 0.01 to 0.02. The inclusion of nitrogen in these amounts is desired in order to form vanadium carbonitrides which are responsible for small but reliable increases in precipitation strengthening. The preferred compositions also include columbium in a preferred range of from about 0.01 to 0.05. The addition of columbium is desired in order to obtain consistent 80 ksi minimum yield strength levels. Columbium also has a beneficial effect on grain size. Steels made with columbium have ferrite grain sizes in the range ASTM 9 to 10, while those made without columbium have ferrite grain sizes of ASTM 7 to 8.

The advantages and the practice of the invention are further demonstrated by the following specific examples.

A number of steels were prepared having the compositions reported in Table II. The steels identified as 583,182-1 and 182-2 were poured as round billets and the other steels were poured as ingots. The ingots and round billets were forged into rounds and then (except for steels 182-1 and 182-2) were processed into 5½" OD by 0.304" wall seamless casing. The round billets made from steels 182-1 and 182-2 were pierced into 5" OD by 0.500" coupling stock.

In all cases the steels were heated to temperatures of about 2250° F. for the piercing operation and then cooled to effect precipitation of vanadium carbides and vanadium carbonitrides.

The pierced products were analyzed for microstructure and mechanical properties. The microstructures were ferrite-pearlite. Casing made from the columbium-containing steel F300 had a ferrite grain size of ASTM 9 to 10, while the other steels had a ferrite grain size of ASTM 7 to 8.

The mechanical properties of yield strength, ultimate tensile strength and elongation are reported in Table III. Except for steel 182-2 which resulted in average yield strengths slightly less than the desired minimum of 80 ksi, the microstructures achieved strength and ductility levels meeting API requirements. Steel F300 showed that optimum mechanical properties can be consistently achieved by compositions that include columbium.

TABLE II

| Heat No. | C | Mn | Si | P | S | Ni | Cb | V | Al | N |
|---|---|---|---|---|---|---|---|---|---|---|
| F299 | 0.18 | 1.50 | 0.29 | 0.010 | 0.022 | 0.02 | .01 | 0.15 | 0.058 | 0.017 |

TABLE II-continued

| Heat No. | C | Mn | Si | P | S | Ni | Cb | V | Al | N |
|---|---|---|---|---|---|---|---|---|---|---|
| F300 | 0.19 | 1.50 | 0.30 | 0.011 | 0.023 | 0.02 | 0.038 | 0.15 | 0.057 | 0.019 |
| 583 | 0.24 | 1.50 | 0.29 | 0.008 | 0.019 | 0.01 | .01 | 0.15 | 0.038 | 0.016 |
| 182-1 | 0.25 | 1.40 | 0.28 | 0.009 | 0.019 | .01 | .01 | 0.15 | 0.036 | 0.016 |
| 18-2 | 0.25 | 1.40 | 0.28 | 0.010 | 0.019 | .01 | .01 | 0.15 | 0.036 | 0.016 |

TABLE III

| Specimen No. | Y.S. (.2% Offset) (ksi) | U.T.S. (ksi) | Elong. (% in 2") |
|---|---|---|---|
| F299 (end) | 78.6 | 102.9 | 23.8 |
| F299 (center) | 80.3 | 104.2 | 23.3 |
| F299 (end) | 82.0 | 104.6 | 23.2 |
| F300 (end) | 82.5 | 114.3 | 16.5 |
| F300 (center) | 83.5 | 113.4 | 19.7 |
| F300 (end) | 88.2 | 117.6 | 17.8 |
| 583 (end) | 78.5 | 112.2 | 21.3 |
| 583 (center) | 83.7 | 111.7 | 21.8 |
| 583 (end) | 87.4 | 113.7 | 22.3 |
| 182-1 (end) | 80.8 | 106.7 | 27.0 |
| 182-1 (center) | 80.0 | 107.0 | 26.7 |
| 182-1 (end) | 81.3 | 107.1 | 26.8 |
| 182-2 (end) | 79.9 | 106.9 | 26.8 |
| 182-2 (center) | 79.4 | 106.4 | 26.7 |
| 182-2 (end) | 78.5 | 106.5 | 26.8 |

It will be seen that the invention provides a practice that makes it possible to produce as-pierced casing and the like meeting API requirements of 80–110 ksi yield strength, 100 ksi minimum ultimate tensile strength, and 12½% minimum elongation in two inches. This is achieved through the use of a carefully controlled, vanadium alloyed composition and a practice which results in grain refinement through interphase precipitation of vanadium carbides, including carbonitrides.

Variations and modifications of the invention may be apparent to those skilled in the art in light of the foregoing detailed disclosure. Therefore, it is to be understood that, within the scope of the appended claims, the invention can be practiced otherwise than as specifically described.

We claim:

1. A process of making as-pierced steel casing characterized in the as-pierced condition by a yield strength of 80–110 ksi, a minimum ultimate tensile strength of 100 ksi, a minimum elongation of 12½% in two inches, and by a ferrite-pearlite microstructure having a ferrite grain size of about ASTM 7 or finer, comprising the steps providing a killed steel consisting essentially in percent by weight of 0.20–0.35 carbon, 1.0–2.0 manganese, up to about 0.60 silicon, up to about 0.04 for each of phosphorous and sulfur, 0.05–0.25 vanadium, at least one of from 0.005–0.025 nitrogen and from 0.01–0.10 columbium, and the balance iron, heating said steel to a temperature of at least about 2200° F. to dissolve vanadium carbides, piercing said steel, and allowing said steel to cool from said temperature to effect precipitation of vanadium carbides with resulting refinement of austenite to a grain size of about ASTM 5 or finer and of ferrite to a grain size of about ASTM 7 or finer.

* * * * *